US008210998B2

(12) United States Patent
Chen et al.

(10) Patent No.: US 8,210,998 B2
(45) Date of Patent: Jul. 3, 2012

(54) ABDOMINAL EXERCISE DEVICE

(76) Inventors: Yi-Tzu Chen, Bade (TW); Chang-Feng Lin, Yonghe (TW)

( * ) Notice: Subject to any disclaimer, the term of this patent is extended or adjusted under 35 U.S.C. 154(b) by 0 days.

(21) Appl. No.: 12/882,530

(22) Filed: Sep. 15, 2010

(65) Prior Publication Data

US 2012/0065037 A1 Mar. 15, 2012

(51) Int. Cl.
*A63B 21/00* (2006.01)

(52) U.S. Cl. ..... 482/130; 482/140

(58) Field of Classification Search ..... 482/130, 482/142, 121, 141, 148
See application file for complete search history.

(56) References Cited

U.S. PATENT DOCUMENTS 5,665,041 A * 9/1997 Hsieh ..... 482/140
5,769,766 A * 6/1998 Huang ..... 482/140
5,871,425 A * 2/1999 Gvoich ..... 482/140
6,168,557 B1 * 1/2001 Liao ..... 482/140

* cited by examiner

*Primary Examiner* — Jerome W Donnelly
(74) *Attorney, Agent, or Firm* — patenttm.us

(57) ABSTRACT

An abdominal exercise device has a base, a seat mounted on the base, a front frame rotatably on a front of the base, a rear frame rotatably mounted on a rear of the base, a connecter connected pivotally to the front frame and the rear frame, an adjusting assembly mounted on the base and at least one resilient element connected to the rear frame and adjusting assembly. The at least one resilient element pulls the rear frame along with the connecter and the front frame to assist in performing sit-ups so abdominal muscles of a user using the abdominal exercise device is trained.

15 Claims, 6 Drawing Sheets

ABDOMINAL EXERCISE DEVICE

BACKGROUND OF THE INVENTION

1. Field of the Invention

The present invention relates to an abdominal exercise device, especially to an abdominal exercise device that is used for training abdominal muscles.

2. Description of the Prior Art(s)

Exercise is one of the best ways to relax and stay healthy. Therefore, although people nowadays usually do not have enough time to exercise outdoors, people do simple exercises, such as sit-ups, push-ups, stretching exercises and the like that require less room indoors to train their bodies.

Among those exercises, doing sit-ups especially train abdominal muscles and hip flexors. However, researches have indicated that when performing sit-ups arching of a back, buttocks and abdominal muscles are affected and vertebral column and lumbar vertebral disc are at risk of damage or injury.

To overcome the shortcomings, the present invention provides an abdominal exercise device to mitigate or obviate the aforementioned problems.

SUMMARY OF THE INVENTION

The main objective of the present invention is to provide an abdominal exercise device. The abdominal exercise device has a base, a seat mounted on the base, a front frame rotatably on a front of the base, a rear frame rotatably mounted on a rear of the base, a connecter connected pivotally to the front frame and the rear frame, an adjusting assembly mounted on the base and at least one resilient element connected to the rear frame and adjusting assembly. The at least one resilient element pulls the rear frame along with the connecter and the front frame to assist in performing sit-ups so abdominal muscles of a user using the abdominal exercise device is trained.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
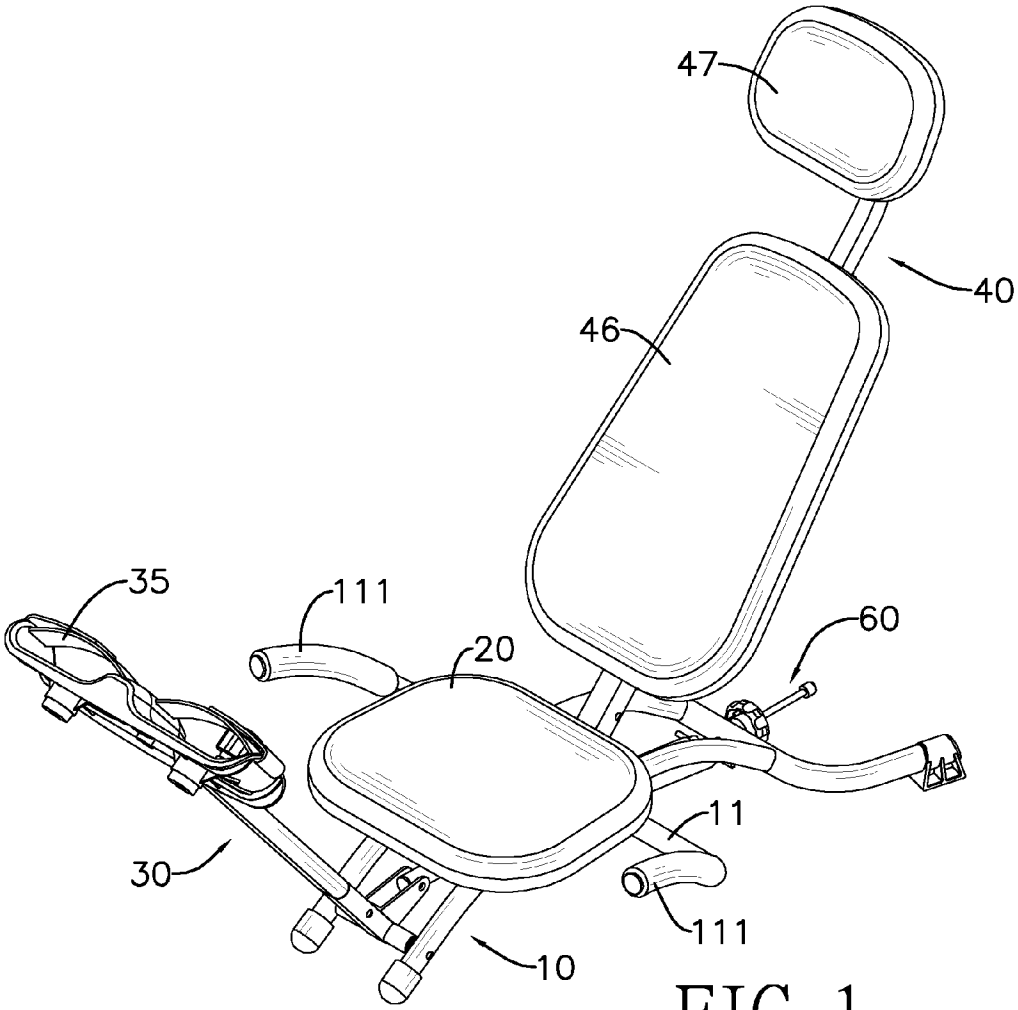
FIG. 1 is a perspective of an abdominal exercise device in accordance with the present invention.
Figure 2:
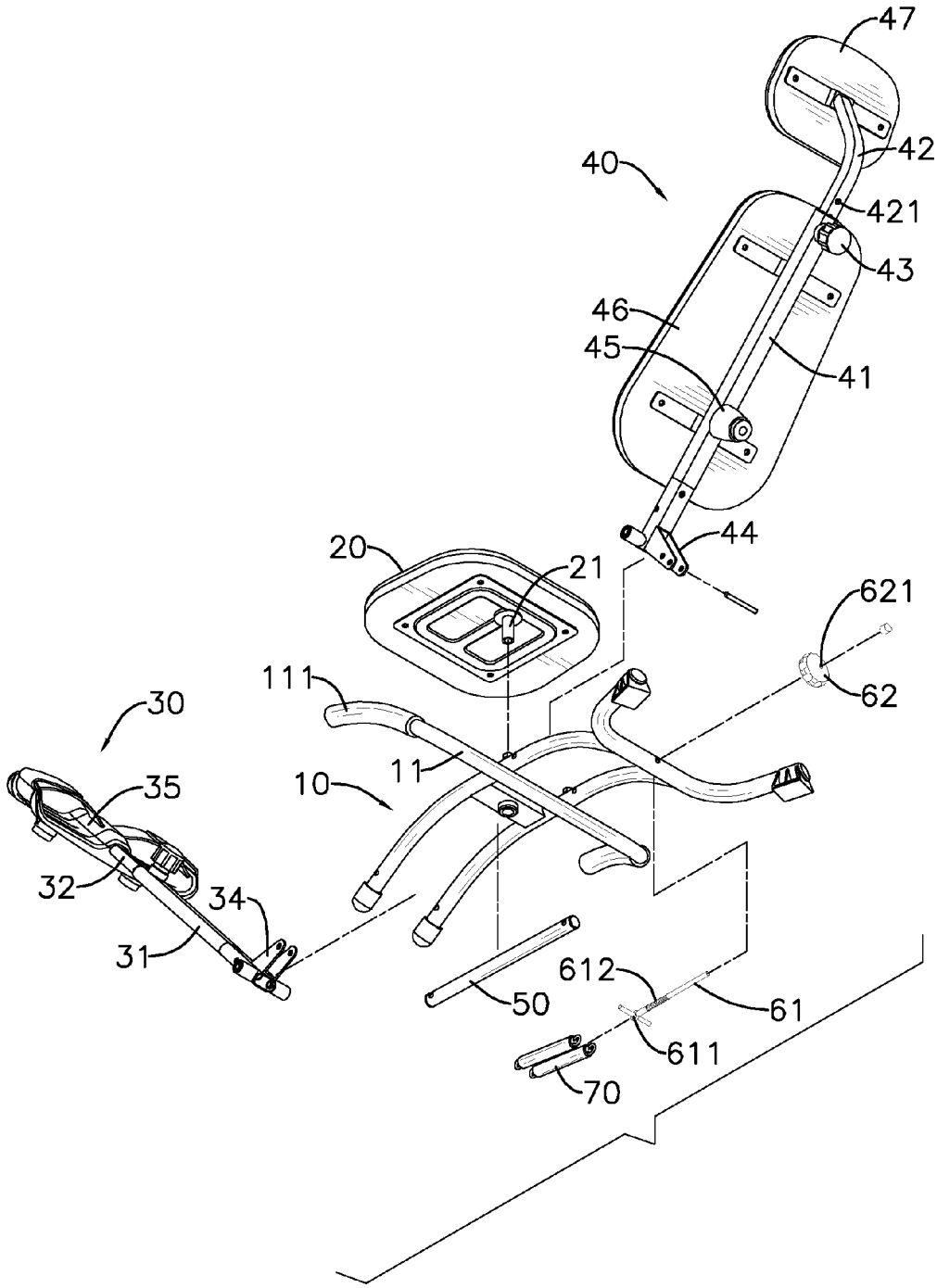
FIG. 2 is an exploded perspective view of the abdominal exercise device in FIG. 1.

With reference to FIGS. 1 and 2, an abdominal exercise device in accordance with the present invention comprises a base 10, a seat 20, a front frame 30, a rear frame 40, a connecter 50, an adjusting assembly 60 and at least one resilient element 70.

The base 10 is placed on a plane and has a body and a handle arm 11. The handle arm 11 is mounted across the body and has two handlebars 111 mounted around two opposite ends of the handle arm 11.

The seat 20 is mounted rotatably on the base 10, corresponds to the handle arm 11 of the base 10 and has a rotating shaft 21 protruding down from a bottom of the seat 20 and mounted rotatably on the base 10.

Figure 3:
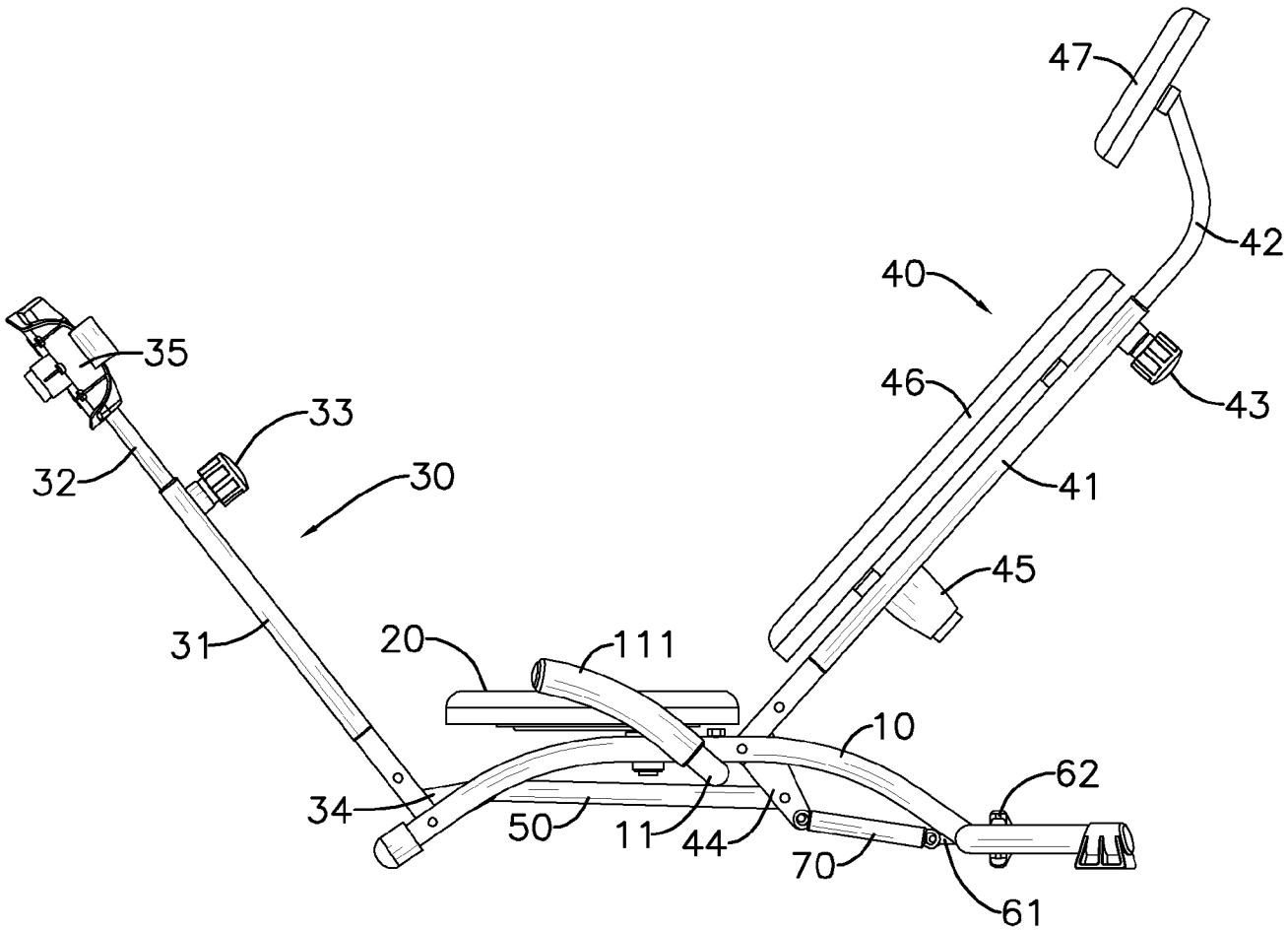
FIG. 3 is a side view of the abdominal exercise device of the FIG. 1.

With further reference to FIG. 3, the front frame 30 is mounted rotatably on a front of the base 10, is retractable and has a proximal end, a distal end, a front outer tube 31, a front inner tube 32, a front pin 33 and a footrest 35. The proximal end of the front frame 30 is connected rotatably to the front of the base 10.

Figure 6:
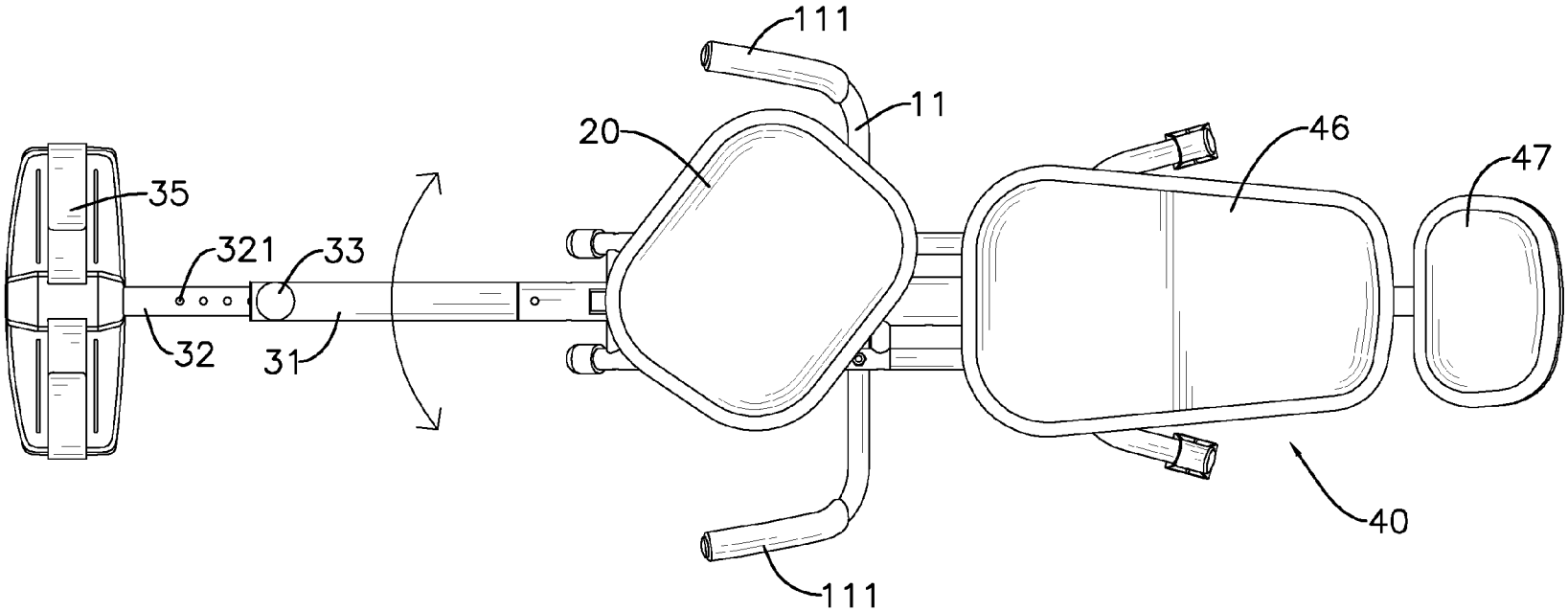
FIG. 6 is an operational top view of the abdominal exercise device.

With further reference to FIG. 6, the front outer tube 31 is connected rotatably to the front of the base 10. The front inner tube 32 is mounted movably in the front outer tube 31 and has multiple adjusting holes 321. The adjusting holes 321 of the front inner tube 32 are formed separately through the front inner tube 32. The front pin 33 is mounted through the front outer tube 31 and selectively engages one of the adjusting holes 321 of the front inner tube 32. Thus, the front frame 30 is retractable to adjust the length of the front frame 30.

The footrest 35 is mounted on the distal end of the front frame 30 and is mounted on the front inner tube 32.

The rear frame 40 is mounted rotatably on a rear of the base 10, is retractable and has a proximal end, a distal end, a rear outer tube 41, a rear inner tube 42, a rear pin 43, a buffer 45, a back pad 46 and a head pad 47. The proximal end of the rear frame 40 is connected rotatably to the rear of the base 10.

The rear outer tube 41 is connected rotatably to the rear of the base 10. The rear inner tube 42 is mounted movably in the rear outer tube 41 and has multiple adjusting holes 421. The adjusting holes 421 of the rear inner tube 42 are formed separately through the rear inner tube 42. The rear pin 43 is mounted through the rear outer tube 41 and selectively engages one of the adjusting holes 421 of the inner tube 42. Thus, the rear frame 40 is retractable to adjust the length of the rear frame 40.

The buffer 45 is mounted on the rear outer tube 41 and selectively abuts the base 10 to prevent the rear outer tube 41 of the rear frame 40 from hitting the base 10.

The back pad 46 is mounted on the rear outer tube 41. The head pad 47 is mounted on the distal end of the rear frame 40 and is mounted on the rear inner tube 42 so that the head pad 47 moves along with the rear inner tube 42.

The connecter 50 is connected pivotally to the front frame 30 via two front connecting wings 34 and the rear frame 40 via two rear connecting wings 44, and is mounted between the proximal ends of the front and rear frames 30, 40.

The adjusting assembly 60 is mounted on the rear of the base 10 and has a pull rod 61 and an adjusting knob 62. The pull rod 61 is mounted slidably through the rear of the base 10 and has a connecting end 611 and an outer thread 612. The connecting end 611 corresponds to the proximal end of the rear frame 40. The outer thread 612 is formed around an outer surface of the pull rod 61. The adjusting knob 62 is mounted on the pull rod 61 and has a through hole 621 and an inner thread. The through hole 621 is formed through the adjusting knob 62 and is mounted around the pull rod 61. The inner thread of the adjusting knob 62 is defined around the through hole 621 and engages the outer thread 612 of the pull rod 61.

The at least one resilient element 70 is connected to the rear connecting wings 44 of the rear frame 40 and the rear of the base 10, is connected to the rear connecting wings 44 of the rear frame 40 and the connecting end 611 of the pull rod 61 and draws the pull rod 61 so that the adjusting knob 62 keeps abutting the base 10. Thus, as the adjusting knob 62 is rotated, the pull rod 61 moves axially and tightness of the at least one resilient element 70 is adjusted. Moreover, the at least one resilient element 70 also draws the rear frame 40 along with the connecter 50 and the front frame 30 so that the rear frame 40 and the front frame 30 are disposed obliquely.

The abdominal exercise device as described has the following advantages. With reference to FIG. 3, as a user uses the abdominal exercise device, the user sit on the seat 20 with hands holding the handlebars 111 of the handle arm 11, back leaning against the back pad 46 of the rear frame 40, head leaning against the head pad 47 of the rear frame 40 and feet placed on the footrest 35 of the front frame 30.

Figure 4:
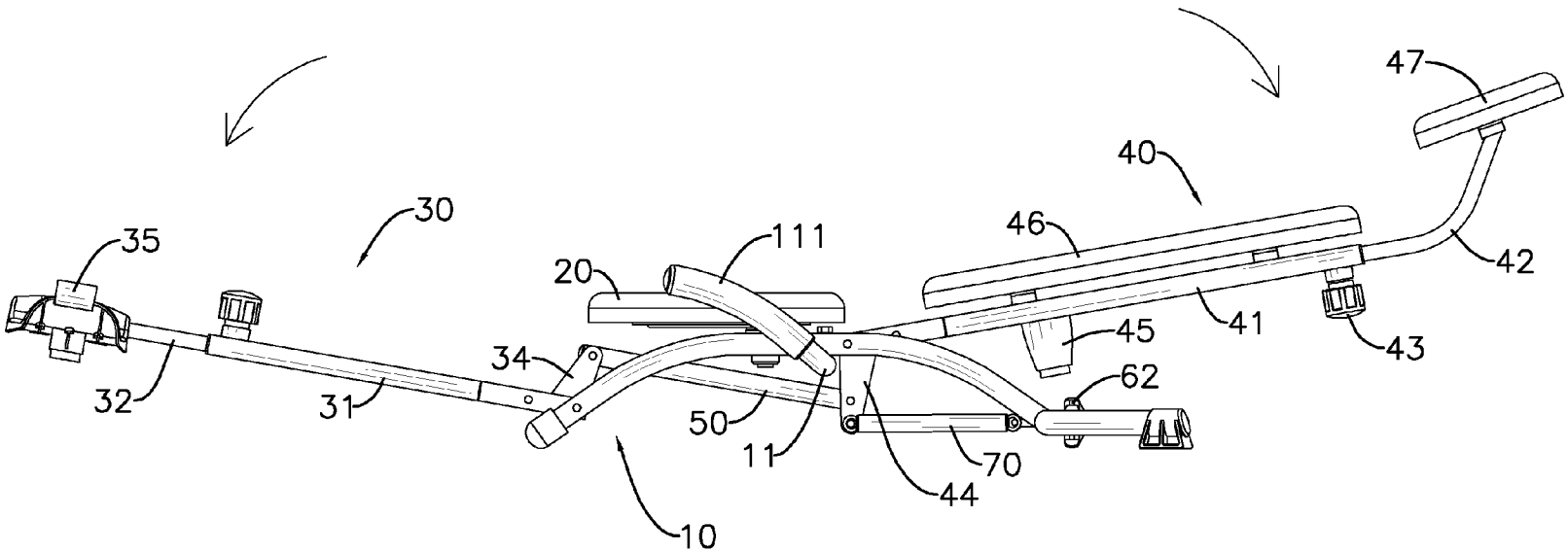
FIG. 4 is an operational side view of the abdominal exercise device in FIG. 1.

With further reference to FIG. 4, then the user presses the rear frame 40 and the front frame 30 to substantially straighten the rear frame 40 and the front frame 30. When the front frame 30 is rotated downwardly, the front connecting wings 34 of the front frame 30 draws the connecter 50 and the rear connecting wings 44 of the rear frame 40 and the rear frame 40 is also rotated downwardly. Consequently, the at least one resilient element 70 is extended.

Thereafter, when the user tends to sit up, the at least one resilient element 70 pulls the rear frame 40 so the rear frame 40 as well as the front frame 30 are rotated upwardly to assist the user to perform a sit-up exercise and to train abdominal muscles of the user.

Figure 5:
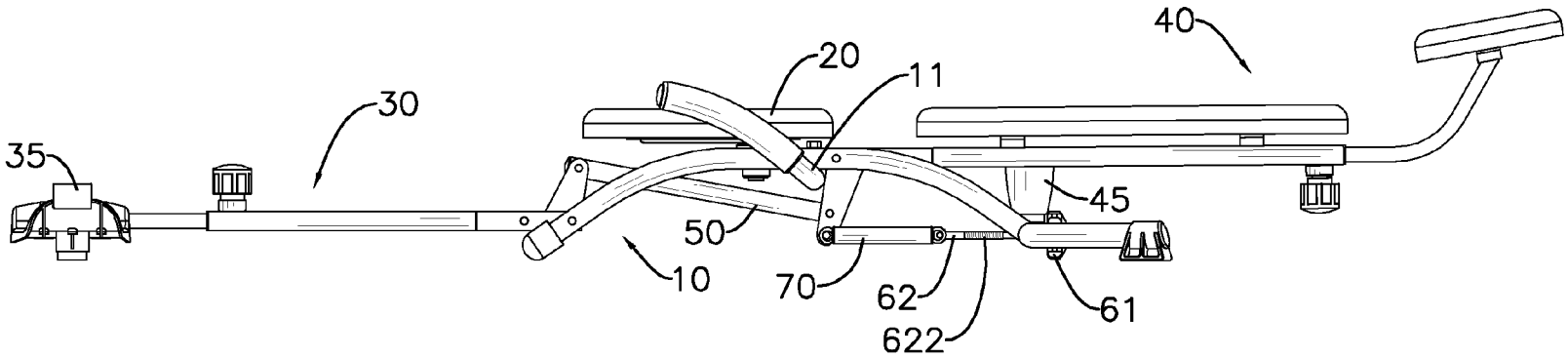
FIG. 5 is another operational side view of the abdominal exercise device in FIG. 1.

Moreover, with further reference to FIGS. 5 and 6, another way to use the abdominal exercise device is to turn the knob 62 until the knob 62 disengages from the pull rod 61. Then, the front frame 30 and the rear frame 40 are laid flat. The user is able to sit on the seat 20 and twist his or her hip and waist. Thus, the user's hip and waist are also exercised.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An abdominal exercise device comprising
- a base;
- a seat mounted rotatably on the base;
- a front frame mounted rotatably on a front of the base and having a proximal end connected rotatably to the front of the base;
- a rear frame mounted rotatably on a rear of the base and having a proximal end connected rotatably to the rear of the base;
- a connecter connected pivotally to the front frame and the rear frame and mounted between the proximal ends of the front and rear frames; and
- at least one resilient element connected to the rear frame and the rear of the base.

2. The abdominal exercise device as claimed in claim 1, wherein the seat has a rotating shaft protruding down from a bottom of the seat and mounted rotatably on the base.

3. The abdominal exercise device as claimed in claim 1, wherein the front frame and the rear frame are retractable.

4. The abdominal exercise device as claimed in claim 2, wherein
- the front frame further has
  - a front outer tube connected rotatably to the front of the base;
  - a front inner tube mounted movably in the front outer tube and having multiple adjusting holes formed separately through the front inner tube; and
  - a front pin mounted through the front outer tube and selectively engaging one of the adjusting holes of the front inner tube;
- the rear frame further has
  - a rear outer tube connected rotatably to the rear of the base;
  - a rear inner tube mounted movably in the rear outer tube and having multiple adjusting holes formed separately through the rear inner tube; and
  - a rear pin mounted through the rear outer tube and selectively engaging one of the adjusting holes of the inner tube.

5. The abdominal exercise device as claimed in claim 4, wherein
- the front frame further has a footrest mounted on the front inner tube; and
- the rear frame further has
  - a buffer mounted on the rear outer tube and selectively abutting the base;
  - a back pad mounted on the rear outer tube; and
  - a head pad mounted on the rear inner tube.

6. The abdominal exercise device as claimed in claim 5, wherein
- the base has
  - a body; and
  - a handle arm mounted across the body and having two handlebars mounted around two opposite ends of the handle arm; and
- the seat corresponds to the handle arm of the base.

7. The abdominal exercise device as claimed in claim 6, wherein
- the connecter is connected pivotally to the front frame via two front connecting wings and to the rear frame via two rear connecting wings; and
- the at least one resilient element is connected to the rear connecting wings of the rear frame.

8. An abdominal exercise device comprising
- a base;
- a seat mounted on the base;
- a front frame mounted rotatably on a front of the base and having a proximal end connected rotatably to the front of the base;
- a rear frame mounted rotatably on a rear of the base and having a proximal end connected rotatably to the rear of the base;
- a connecter connected pivotally to the front frame and the rear frame and mounted between the proximal ends of the front and rear frames;
- an adjusting assembly mounted on the rear of the base and having
  - a pull rod mounted slidably through the rear of the base and having
    - a connecting end corresponding to the proximal end of the rear frame; and
    - an outer thread formed around an outer surface of the pull rod; and
  - an adjusting knob mounted on the pull rod and having
    - a through hole formed through the adjusting knob and mounted around the pull rod; and
    - an inner thread defined around the through hole and engaging the outer thread of the pull rod; and
- at least one resilient element connected to the rear frame and the connecting end of the pull rod.

9. The abdominal exercise device as claimed in claim 8, wherein the seat is mounted rotatably on the base.

10. The abdominal exercise device as claimed in claim 9, wherein the seat has a rotating shaft protruding down from a bottom of the seat and mounted rotatably on the base.

11. The abdominal exercise device as claimed in claim 9, wherein the front frame and the rear frame are retractable.

12. The abdominal exercise device as claimed in claim 10, wherein the front frame further has a front outer tube connected rotatably to the front of the base;

a front inner tube mounted movably in the front outer tube and having multiple adjusting holes formed separately through the front inner tube; and a front pin mounted through the front outer tube and selectively engaging one of the adjusting holes of the front inner tube;

the rear frame further has a rear outer tube connected rotatably to the rear of the base;

a rear inner tube mounted movably in the rear outer tube and having multiple adjusting holes formed separately through the rear inner tube; and a rear pin mounted through the rear outer tube and selectively engaging one of the adjusting holes of the inner tube.

13. The abdominal exercise device as claimed in claim 12, wherein the front frame further has a footrest mounted on the front inner tube; and the rear frame further has a buffer mounted on the rear outer tube and selectively abutting the base;

a back pad mounted on the rear outer tube; and a head pad mounted on the rear inner tube.

14. The abdominal exercise device as claimed in claim 13, wherein the base has a body; and a handle arm mounted across the base and having two handlebars mounted around two opposite ends of the handle arm; and the seat corresponds to the handle arm of the base.

15. The abdominal exercise device as claimed in claim 14, wherein the connecter is connected pivotally to the front frame via two front connecting wings and to the rear frame via two rear connecting wings; and the at least one resilient element is connected to the rear connecting wings of the rear frame.

* * * * *